US005102260A

United States Patent [19]

Horvath et al.

[11] Patent Number: 5,102,260

[45] Date of Patent: Apr. 7, 1992

[54] GEOINCLUSION METHOD AND COMPOSITE

[76] Inventors: John S. Horvath, 148 Johnson Rd., Scarsdale, N.Y. 10583; John D. VanWagoner, 8554 Georgetown Pike, McLean, Va. 22102

[21] Appl. No.: 642,644

[22] Filed: Jan. 17, 1991

[51] Int. Cl.[5] ..... E02B 11/00; E02D 31/02

[52] U.S. Cl. ..... 405/50; 52/169.5; 52/169.14; 405/45; 405/284

[58] Field of Search ..... 405/43, 45, 50, 284–287; 52/169.5, 169.11, 169.14

[56] References Cited

U.S. PATENT DOCUMENTS

| | | | |
|---|---|---|---|
| 3,965,686 | 6/1976 | Saito et al. | 405/43 |
| 4,304,824 | 12/1981 | Karpinski | 428/69 |
| 4,309,855 | 1/1982 | Pate et al. | 52/169.5 |
| 4,538,387 | 9/1985 | Barnett et al. | 52/169.5 |
| 4,572,700 | 2/1986 | Mantarro et al. | 404/35 |
| 4,574,541 | 3/1986 | Raidt et al. | 52/169.5 |
| 4,704,048 | 11/1987 | Ahlgrimm | 405/45 |
| 4,730,953 | 3/1988 | Tarko | 405/45 |
| 4,733,989 | 3/1988 | Harriett | 405/43 |
| 4,768,897 | 9/1988 | Nussbaumer et al. | 405/50 X |
| 4,815,963 | 3/1989 | Berkhout | 428/283 |
| 4,825,342 | 5/1990 | Hendy | 405/45 |
| 4,840,515 | 6/1989 | Freese | 405/45 |
| 4,880,333 | 11/1989 | Glasser et al. | 405/43 |

*Primary Examiner*—David H. Corbin
*Attorney, Agent, or Firm*—Bradford E. Kile

[57] ABSTRACT

A geoinclusion method and composite having a compressible layer operable to be positioned adjacent to a retaining wall surface and an insulation and drainage layer with voids coextensive with the compressible layer but having a density substantially greater than the density of the composite layer.

11 Claims, 2 Drawing Sheets

GEOINCLUSION METHOD AND COMPOSITE

BACKGROUND OF THE INVENTION

This invention relates to a novel method and geosynthetic panel assembly for reducing horizontal stresses acting on relatively rigid earth retaining structures. More specifically, this invention relates to a geoinclusion composite for allowing deformation of earth materials retained by subterranean walls, retaining walls, bridge abutments, navigation locks and the like.

Typically, relatively rigid earth retaining structures are composed of reinforced concrete or other suitable rigid materials that prevent or restrict deformation of the earth materials retained by such structures. Because of their rigidity, relatively large horizontal stresses may develop on such structures that can cause cracking, bowing, or even collapse of the structure. Consequently, rigid earth retaining structures can have high initial cost and may require maintenance and, in some instances, replacement.

Additional horizontal stresses may be caused by surface surcharge load. For example, there are many situations, particularly in the transportation field, where it is desirable to add or significantly increase a surface surcharge load adjacent to an existing wall. In transportation applications, this could involve loads from motor vehicles, aircraft, or trains adjacent to a bridge abutment or retaining wall that significantly exceed the original design load.

Accordingly, it may be desirable to limit stresses on relatively rigid earth retaining structures. One method of limiting the stress that has been attempted is to place synthetic reinforcement materials within the earth materials retained by the structure. However, this is generally unsuccessful as the rigidity of the retaining structure prevents the soil from deforming horizontally. This is necessary for the reinforcement to stretch and be activated. An option employed in the past has been to leave a void next to the soil-side face of the retaining structure in order to create an area for horizontal deformation of the earth materials. However, a void having an adequate width can be difficult to create during construction, and may result in maintenance or other operational problems after the wall is in service.

The difficulties suggested in the preceding are not intended to be exhaustive but rather are among the many that may tend to increase the cost and/or reduce the effectiveness of rigid earth retaining structures. Other noteworthy problems may also exist; however, those presented above should be sufficient to demonstrate that prior panel assemblies appearing in the past will admit to worthwhile improvement.

OBJECTS and BRIEF SUMMARY OF THE INVENTION

Objects

It is therefore a general object of the invention to provide a novel geoinclusion composite that will obviate or minimize difficulties of the type previously described.

It is a specific object of the invention to provide a geoinclusion composite that permits retained earth materials containing synthetic reinforcement to deform horizontally without providing significant resistance to this deformation, thereby reducing horizontal stress to a rigid earth retaining structure thereby improving the stability of the structure.

It is a further object of the invention to provide a method and apparatus for permitting retained earth materials without synthetic reinforcement to deform horizontally without providing significant resistance to mobilize the shear strength of the earth material and reduce horizontal earth pressures on the retaining structure.

It is another object of the invention to provide a geoinclusion composite that reduces hydrostatic pressure when placed against a wall surface.

It is still another object of the invention to provide a geoinclusion composite that will thermally insulate an earth retaining structure from the surrounding earth environment.

It is yet another object of the present invention to provide a geoinclusion that will thermally insulate retained earth materials which may or may not contain synthetic reinforcement from radiant heating through an exposed retaining wall surface.

It is a further object of the invention to provide a geoinclusion composite that will attenuate transmission of noise and vibrations between earth materials and a subterranean wall, retaining wall, or the like.

It is yet a further object of the invention to provide a geoinclusion composite that is lightweight and, therefore, easy to transport and install.

It is still a further object of the invention to provide a geoinclusion composite that will not degrade in situ and is biocompatible with chemicals in the soil.

It is yet still another object of the invention to provide a geoinclusion composite that is inexpensive to produce and easily manufactured.

BRIEF SUMMARY OF A PREFERRED EMBODIMENT OF THE INVENTION

A preferred embodiment of the invention that is intended to accomplish at least some of the foregoing objects comprises a geoinclusion composite formed for placement adjacent to an earth retaining structure for accommodating horizontal deformation of the retained earth materials. The subject geoinclusion composite may include a waterproofing layer placed against the soil-side face of, for example, a subterranean wall, and a compressible layer that extends parallel to and is generally coextensive with the waterproofing layer. A drainage layer having a higher density than the compressible layer is positioned parallel to the compressible layer. The drainage layer includes void spacing that permits the passage of water or other fluids to relieve hydrostatic pressure against the wall surface.

In addition to the compressible layer and the drainage layer, the subject geoinclusion composite includes a water permeable membrane that extends parallel to and is generally coextensive with the drainage layer. The water permeable membrane is composed of a woven or non-woven geotextile that operably restricts earth particles from entering the drainage layer and enhances development of a natural filtration zone within the adjacent earth materials.

The subject geoinclusion composite operably permits the retained earth materials to deform horizontally without providing significant resistance to advantageously utilize the inherent shear strength of the earth material as well as any synthetic reinforcement placed within the earth material, thereby reducing the lateral stress delivered to the structure.

THE DRAWINGS

Other objects and advantages of the present invention will become apparent from the following detailed description of a preferred embodiment thereof, taken in conjunction with the accompanying drawings, wherein:

FIG. 1 is an axonometric view disclosing a context of the subject invention and depicts a geoinclusion in accordance with a preferred embodiment of the invention placed adjacent a subterranean wall;

FIG. 2, note sheet two, is a side elevation view, in cross section, disclosing an alternative context of the subject invention and depicts a geoinclusion composite placed adjacent a retaining wall; and FIG. 3 is a sectional partial view of a preferred embodiment of the subject geoinclusion composite.

DETAILED DESCRIPTION

Context of the Invention

Figure 1:
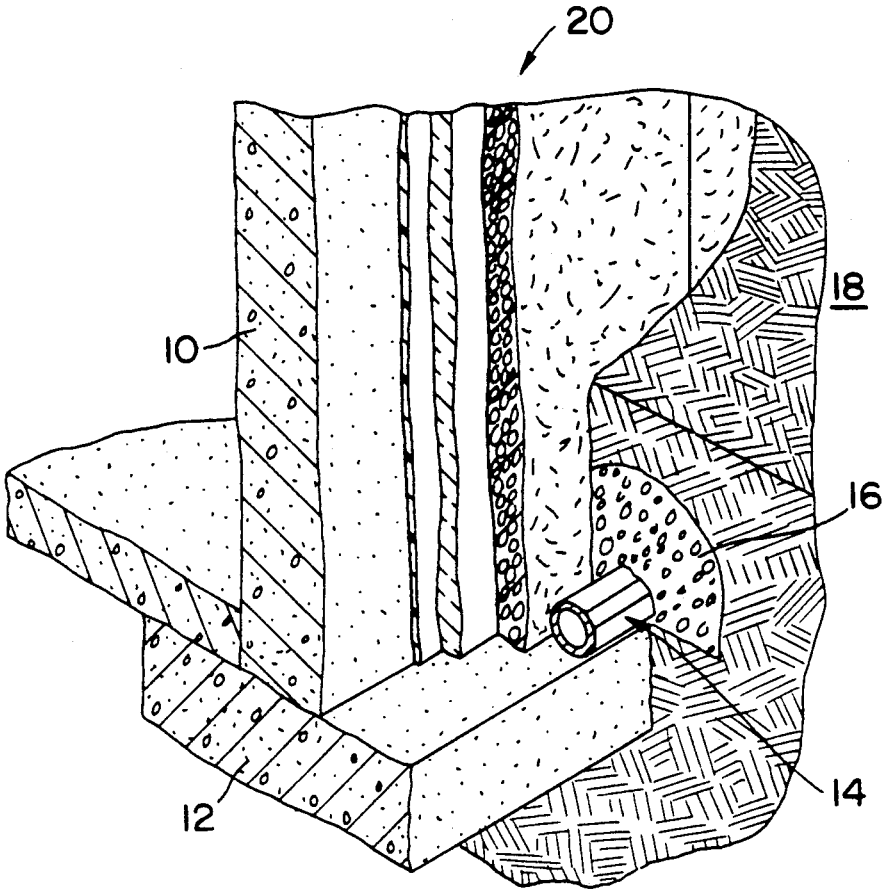

Before discussing in detail a preferred embodiment of the subject geoinclusion and method, it may be useful to briefly outline an operative environment of the invention. Referring to the drawings, wherein like numerals indicate like parts, and initially to FIG. 1, there will be seen a retaining wall 10 that may be composed of cinder block, poured or precast concrete, or the like. Such walls typically comprise retaining walls for roadways and the like and may rest upon a concrete footing 12. In order to reduce hydrostatic pressure buildup on the exterior surface of the wall 10, a porous fluid handling conduit 14 is positioned atop the footing 12 for collecting and directing water or other fluids from the earth material surrounding the wall away from the wall. An aggregate material 16 composed of gravel or crushed rock surrounds the fluid handling conduit 14 and serves as a coarse filter and to restrict particles of earth from entering the conduit. An earth formation 18, which may or may not contain synthetic reinforcement, surrounds the wall, and produces horizontal stresses against the subterranean wall. This earth formation 18 may also transmit stresses from surface leads.

A geoinclusion composite 20 in accordance with a preferred embodiment of the invention is also shown in FIG. 1. In an operative posture, the composite 20 is positioned between the ambient earth materials and the subterranean wall 10 to operably compress under the horizontal stresses applied to the wall by the earth formation 18. The detailed structure and the advantages of this novel geoinclusion composite will be discussed below in conjunction with FIG. 3.

Figure 2:
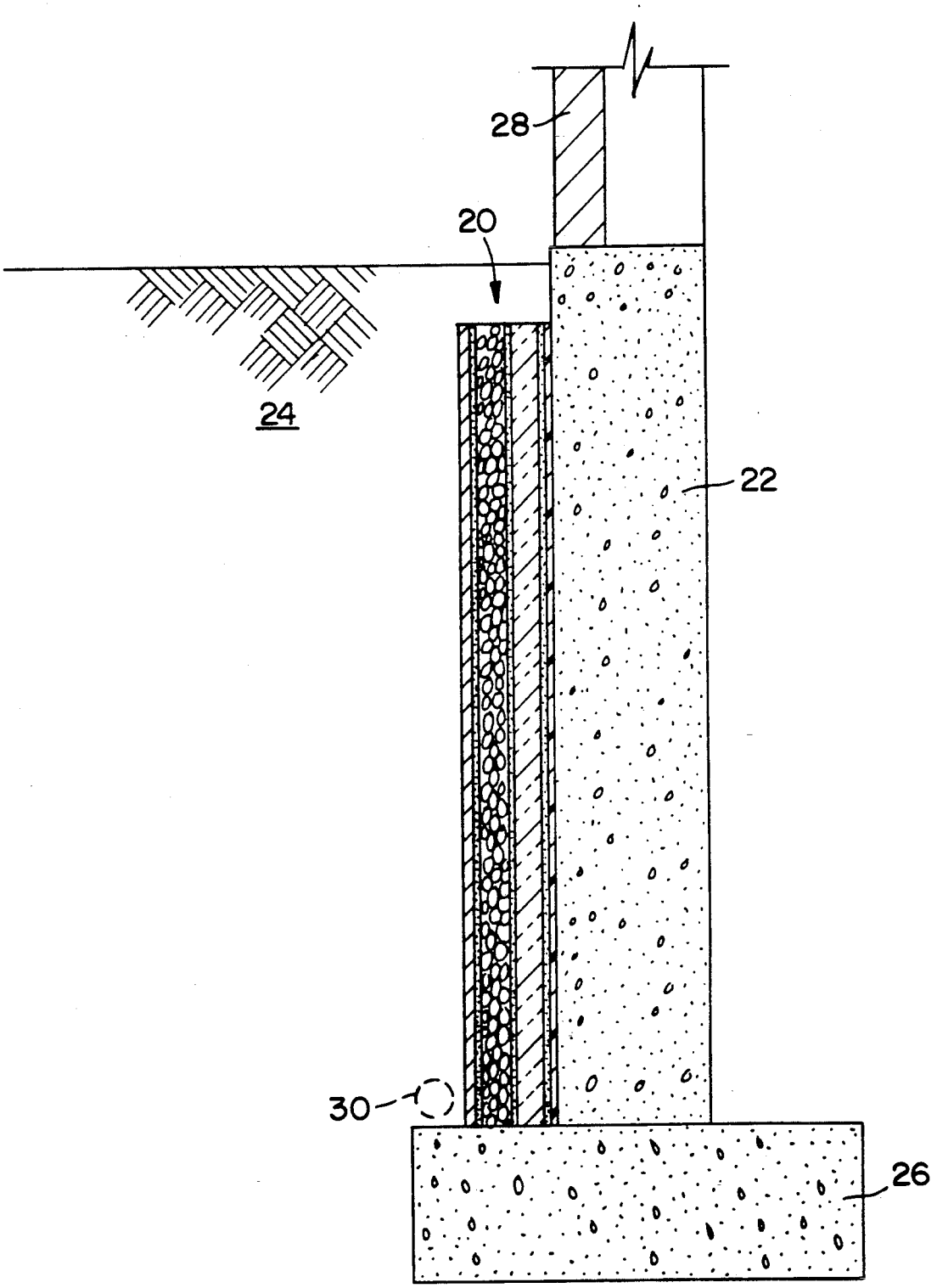

Turning now to FIG. 2, there will be seen a second operative environment suitable to illustrate an advantageous use of the subject invention. Here, the subject geoinclusion composite 20 is shown positioned between another form of retaining wall 22 and earth material 24, which may or may not contain synthetic reinforcement, supported by the retaining wall. The retaining wall rests on a footing 26 which is level with or positioned slightly below a ground surface on an exposed side of the retaining wall 22. A plastic, metal, concrete, or wood noise abatement or guard wall 28, such as frequently used to border highways, freeways, and the like may be mounted atop the retaining wall 22. A fluid handling conduit 30 is positioned adjacent the footing 26 to operably relieve hydrostatic pressure buildup against the retaining wall 22. In this context, compression of the geoinclusion composite serves to reduce horizontal stresses applied to the retaining wall caused by the earth material 24.

Geoinclusion Composite

Figure 3:
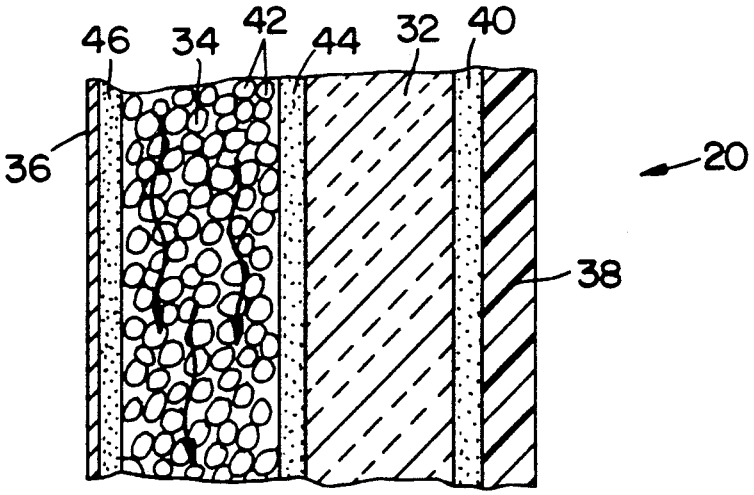

FIG. 3 discloses a partial sectional view of the subject geoinclusion composite 20 in accordance with a preferred embodiment of the invention. The subject geoinclusion composite 20 generally is comprised of a compressible layer 32, a drainage layer 34, and a water permeable membrane 36. The geoinclusion composite 20 may be operably affixed to a waterproofing layer 38 which is applied to a wall surface or the like. The waterproofing layer 38 may be formed from a variety of materials, but preferably is composed of a coating of bituminous or sheet membrane waterproofing material, such as polyethylene, polyvinyl chloride or similar waterproof or vapor retarding materials.

The compressible layer 32 may be adhesively secured to the waterproofing layer 38 by adhesive layer or spots 40. The adhesive layer or spots must be applied to the waterproofing layer 38 in sufficient quantity to hold the compressible layer 32 in place until installation of the geoinclusion composite is completed and the earth materials are deposited adjacent the subterranean or retaining wall surface.

The compressible layer 32 is preferably composed of expanded polystyrene, but may alternatively be composed of fiberglass, polyurethane, polyisocyanurate, extruded polystyrene, or any other similar compressible material. This layer 32 has a relatively low density of, in a preferred embodiment, approximately 0.7 pounds per cubic foot to permit the layer to compress under pressure caused by the surrounding earth material. In addition, the compressible layer 32 operably retains a high insulative value in a below-grade environment where the layer will be subjected to moist earth and water.

The drainage layer 34 is operably positioned parallel to the compressible layer 32 and is preferably composed of beads or spheres 42 of expanded polystyrene lightly bonded or fused together at random touching surface locations. This random arrangement creates void spacing that permits water and other liquids to flow through the drainage layer 34 to relieve hydrostatic pressure buildup adjacent the associated wall surface. The direction of fluid flow is shown by serpentine arrows.

Sphere fusing can be achieved by a steam fusion technique in a mold, or bonding can be accomplished with a light coating of a latex bituminous emulsion or similar adhesive. While a spherical configuration for the beads is preferred, other three dimensional configurations are contemplated by the subject invention such as cubes, solid rectangles, or other polyhedron configurations and the like as desired. In addition, materials other than polystyrene may be used in practicing the invention, such as polyisocyanurate, polyurethane and the like. Moreover, the drainage layer may include a plastic core material or randomly woven plastic wire.

The drainage layer has a density approximately equal to 2.0 pounds per cubic foot, but the density is substantially greater than that of the compressible layer. The density of the drainage layer permits the layer to slightly compress in response to the horizontal stress of the adjacent earth materials. However, the degree to which the drainage layer compresses may not be sufficient to produce all of the desired deformation of the retained earth materials. By combining the compressible layer with the drainage layer, the subject geoinclusion achieves an advantageous degree of compression to reduce the horizontal stress applied to the wall surface which, in turn, decreases the likelihood of structural deformation or cracking or failure of the subterranean or retaining wall. Moreover as stated above, planned accommodation for a degree of horizontal deformation of the retained earth material mobilizes the shear strength of the earth material and tensile resistance of any synthetic reinforcement included therein.

The drainage layer 34 is adhesively secured to the compressible layer 32 by an adhesive layer or spots 44. The specific adhesive used must be compatible with the materials composing the drainage layer and the compressible layer, and this adhesive must also maintain the positioning of the two layers until completion of the installation procedures.

A water permeable membrane 36, or geotextile, is adhesively attached to drainage layer 34 by adhesive layer or spots 46 to restrict particles of the retained earth materials from entering the drainage layer 34. Suitable geotextiles include a regular or random weave of polyprophlene, fiberglass, or similar drainage fabrics, that are chosen depending on the surrounding earth materials.

An alternative method of attaching the layers of the subject geoinclusion composite to a wall structure includes mounting a plurality of stick clips to the appropriate wall surface and impaling the layers on the stick clips. Additional methods include using various manual or power activated nailing systems to secure the layers, applying preformed tape with two self-adhering surfaces between the layers, or applying mechanical fasteners between the various layers.

The layers of the subject invention may be installed individually, or the geoinclusion composite may be prefabricated in a shop and shipped to a construction site.

In another embodiment of the invention, the subject geoinclusion composite 20 may be used in combination with synthetic reinforcements, such as layers, sheets, or strips of polymeric or metallic material, that are placed in one or more generally horizontal layers behind the earth retaining structure. The addition of synthetic reinforcements to earth material retained by a structure is generally referred to as mechanically stabilized earth. The compressibility of the subject geoinclusion composite permits the earth materials and the synthetic reinforcements to deform in instances where the rigidity of the structure would have previously prevented deformation, rendering the reinforcement of little or no technical benefit. In certain situations, the combination of the subject geoinclusion composite with synthetic reinforcements can eliminate the earth pressure that would otherwise be input onto a wall structure.

SUMMARY OF MAJOR ADVANTAGES OF THE INVENTION

After reading and understanding the foregoing inventive geoinclusion composite, in conjunction with the drawings, it will be appreciated that several distinct advantages of the subject invention are obtained. Without attempting to set forth all of the desirable features of the instant geoinclusion method and composite, at least some of the major advantages of the invention include the provision of a compressible layer 32 that compresses under loading to allow deformation and concomitant controlled yielding of the retained earth materials. When the earth materials are subjected to additional forces or stresses caused by transient external events, such as vehicle traffic, earth tremors, or explosive blasts, etc. the compressible layer acts as a shock absorber to reduce the increase in lateral pressure due to the transient event. Moreover, in instances where the earth materials are composed of materials that are susceptible to swelling, such as moisture-sensitive clays or rock, the compressible layer permits expansion of the earth material and concomitant stress relief without transferring the stress to the wall structure. In addition, after the earth materials are frozen, the compressible layer permits the earth material to deform or expand without affecting the integrity of the wall structure.

The relative density of the subject geoinclusion composite provides for compressibility of an inner layer while maintaining the structural integrity and openness of the insulation and drainage layer.

In another aspect of the invention, the subject geoinclusion composite includes, in combination, a drainage layer 34 that eliminates hydrostatic pressure buildup against the subterranean wall, retaining wall, or the like. Eliminating hydrostatic pressure buildup reduces the likelihood of cracking or failure of the wall structure.

The subject geoinclusion composite 20 also serves as an insulator between the retained earth materials and an associated wall structure. If the geoinclusion composite is used in conjunction with a subterranean wall defining a foundation of a building, the invention maintains the temperature differential between the occupiable space and the earth materials. Without the insulation, it would be necessary to heat or cool a mass of earth material surrounding the foundation to maintain the desired temperature within the occupied space. In most cases, the surrounding earth creates a heat sink approximately equal to 55 degrees Fahrenheit. In such situations, the insulative aspect of the invention transfers the dew point to the soil side of the subterranean wall. Accordingly, the dampness and musty odor typical of most below-ground spaces is reduced.

If the geoinclusion is used in conjunction with a retaining wall, bridge abutment, or similar structure such that the exterior face of the wall is subjected to warming by solar radiation, the subject geoinclusion composite 20 will significantly reduce the propagation of heat through the wall and into the retained soil. This is important in situations where the retained earth material comprises mechanically stabilized earth because the creep rate and concomitant loss of strength of polymeric materials increases significantly with increases in temperature. Thus, the geoinclusion composite permits safer and more efficient use of polymeric reinforcements.

Because the materials that compose the compressible layer and the drainage layer have resilient properties, the subject geoinclusion composite serves to attenuate noise and/or vibrations created by vehicular or rail traffic, mechanical equipment, or the like.

In describing the invention, reference has been made to preferred embodiments. Those skilled in the art, however, and familiar with the disclosure of the subject invention, may recognize additions, deletions, substitutions, modifications, and/or other changes that will fall within the purview of the invention as defined in the claims below.

What is claimed is:

1. A geoinclusion composite for allowing deformation of earth materials adjacent to a retaining wall, and the like, said geoinclusion composite comprising:

a compressible layer operable to extend along a retaining wall said compressible layer being composed of a material having resilient properties;

an insulation and drainage layer extending parallel to and being generally coextensive with said compressible layer, said drainage layer being composed of an aggregate of insulation members disposed in a generally homogeneous arrangement to create random void spacing between said insulation members to permit the tortuous passage of water or other fluids through said drainage layer to operably relieve hydrostatic pressure against the retaining wall surface, said drainage layer having a density greater than that of said compressible layer;

a water permeable membrane extending parallel to and being generally coextensive with said drainage layer, said water permeable membrane being composed of a geotextile that operably restricts particles of earth materials from traversing said water permeable membrane and entering the voids in said drainage layer; and said compressible layer and said insulation and drainage layer operably permitting deformation of the surrounding earth material, thereby reducing the stress delivered to the retaining wall surface.

2. A geoinclusion composite as defined in claim 1 wherein:

a waterproofing layer may be applied to the retaining wall surface and said compressible layer is adhesively secured to said waterproofing layer.

3. A geoinclusion composite as defined in claim 1 wherein:

said compressible layer has a density approximately equal to 0.7 pounds per cubic foot.

4. A geoinclusion composite as defined in claim 1 or 3 wherein:

said compressible layer is composed of expanded polystyrene.

5. A geoinclusion composite as defined in claim 1 wherein:

said insulation and drainage layer is adhesively secured to said compressible layer.

6. A geoinclusion composite as defined in claims 1 or 3 wherein:

said drainage layer has a density approximately equal to 2.0 pounds per cubic foot.

7. A geoinclusion composite as defined in claim 1 or 3 wherein:

said insulation members of said insulation and drainage layer are composed of expanded polystyrene.

8. A geoinclusion composite as defined in claim 1 wherein:

said water permeable membrane is adhesively secured to said drainage layer.

9. A geoinclusion composite as defined in claim 1 wherein:

said compressible layer and said drainage layer have insulative properties.

10. A geoinclusion composite for allowing horizontal deformation of earth materials adjacent a retaining wall, and the like, said geoinclusion composite comprising:

a compressible layer extending parallel to and being generally coextensive with a waterproofing layer disposed on a wall surface, said compressible layer being composed of a material having resilient properties;

an insulation and drainage layer extending parallel to and being generally coextensive with said compressible layer, said drainage layer having void spacing that permits the passage of water or other fluids for operably relieving hydrostatic pressure against the retaining wall surface, said insulation and drainage layer having a density greater than the density of said compressible layer; and a water permeable membrane extending parallel to and being generally coextensive with said drainage layer,said water permeable membrane being composed of a filter fabric that operably restricts particles of earth materials from traversing said water permeable membrane and entering the voids in said drainage layer; and said compressible layer and said insulation and drainage layer operably reducing horizontal stresses applied to said geoinclusion composite by the surrounding earth material, thereby reducing the stress delivered to the wall surface.

11. A method for allowing deformation adjacent to a retaining wall and the like, said method comprising the steps of:

installing a compressible layer adjacent to a retaining wall surface, the compressible layer being composed of a material having resilient properties; and installing an insulation and drainage layer co-extensively with said compressible layer and having drainage voids there throughout with a density per cubic foot greater than the density of the compressible layer;

wherein lateral deformation of an earth formation adjacent the retaining wall will be accommodated by compression of the compressible layer adjacent the retaining wall while the insulation and drainage layer maintains its configuration to relieve hydrostatic buildup from the retaining wall.

* * * * *